United States Patent [19]

Ventura

[11] 4,407,314

[45] Oct. 4, 1983

[54] COMBINED COIN SAVER, COUNTER AND WRAPPER

[76] Inventor: Gerard V. Ventura, 131 Richmond Ave., West Haven, Conn. 06516

[21] Appl. No.: 236,452

[22] Filed: Feb. 20, 1981

[51] Int. Cl.[3] ..... G07D 9/06

[52] U.S. Cl. ..... 133/8 A; 53/254

[58] Field of Search ..... 133/1 A, 8 A, 8 D, 1 R, 133/8 R; 53/254

[56] References Cited

U.S. PATENT DOCUMENTS 1,274,615 8/1918 Sherwood ..... 133/1 A

*Primary Examiner*—Stanley H. Tollberg

*Attorney, Agent, or Firm*—Harry J. Gwinnell

[57] ABSTRACT

A combined coin counter and saver is disclosed which also provides for improved ease in coin wrapping. A tube of sufficient diameter to contain a column of coins is mounted on a base section containing a coin support which supports a column of coins at a height coincident with the top of the tube to provide a definite coin count. For example, the tube and post can be so sized as to support a column of 50 pennies when filled to the top of the tube. The tube is also of sufficient diameter to allow a coin wrapper to slide up and down over the coins. The tube section contains a push element at its base slideably mounted around the post such that when the push element is raised to its uppermost position, it raises the wrapper to produce an equal amount of unfilled wrapper extending on either side of the column of coins, leaving the column of coins undisturbed. This provides a fast and efficient method for coin wrapping. After raising and lowering the push element, the top portion of the coin wrapper can be folded down over the coins and the tube inverted to allow the partially wrapped column of coins to be ejected at which point the coin wrapping can be easily completed by simply closing the wrapper on the other, unwrapped end of the column of coins.

10 Claims, 8 Drawing Figures

COMBINED COIN SAVER, COUNTER AND WRAPPER

DESCRIPTION

1. Technical Field

The field of art to which this invention pertains is containers and specifically containers and holders for coins.

2. Background Art

While there have been many attempts at designing containers for holding and counting coins, the end result with all such containers is still the manual wrapping of coins. The most popular containers are those such as the transparent semicircular type with graduated markings to indicate coin count. And while these are quite adequate for saving coins, they still present the problem of fumbling with coins when the coins must be removed and transported, for example, in coin wrapping. Although this is a relatively minor problem with a limited number of coins, with a large volume of coins such a process can be a highly tedious, labor intensive task. Accordingly, what is needed in this area is a coin saver which will not only provide a convenient and accurate way of saving and counting coins, but will provide assistance in the more tedious task of coin wrapping.

DISCLOSURE OF INVENTION

The present invention is directed to a coin saver and counter which also facilitates coin wrapping by eliminating individual coin handling. The coin saver according to the present invention comprises a hollow elongated member for containing the coins having located therein a coin support to support the coins. The elongated member is of large enough diameter to contain the coins stacked flat in column fashion. The elongated member is also of large enough diameter to contain a wrapper in open cylindrical form to surround the coins. The elongated member also contains a push means which raises the wrapper by sliding it to a height equal to about one-half the unfilled portion of the wrapper above the coins when full. This push means can comprise a separate sliding member which surrounds the coin support traversing the elongated member, or it can comprise the base of the elongated member itself, slideably mounted on the coin support.

The method of saving, counting, and wrapping the coins is also described comprising inserting the wrapper into the coin saver to a height no greater than the top of the elongated member in its lowered position, filling the wrapper in the elongated member to a height equal to the height of the elongated member in its lowered position, raising the push means to produce an equal amount of unfilled coin wrapper on either side of the column of coins, wrapping that portion of the unfilled coin wrapper extending above the elongated member, removing the coin-filled wrapper from the elongated member and wrapping the remaining unwrapped portion of the coin wrapper to produce a coin-filled coin wrapper of exact coin count. This push means functions to raise the wrapper above the level of the elongated member without moving the coins. The elongated member is also sized such that when full of coins, the top level of the coins coincides with the top of the elongated member in its lowered position. The elongated member is also sized such that the top level of the wrapper can rest no higher than the top of the elongated member. In operation, when the push means is raised, the wrapper rises above the height of the elongated member and can be folded down over the coins. Upon folding the wrapper down, the elongated member can be inverted and the wrapper containing the coins deposited in one's hand. The other end of the wrapper can then be folded over the coins, completing the wrapping of the coins with minimal handling.

The foregoing, and other features and advantages of the present invention, will become more apparent from the following description and accompanying drawings.

FIGS. *7a* and *7b* are top views of an assembly spline according to the present invention.

Figure 1:
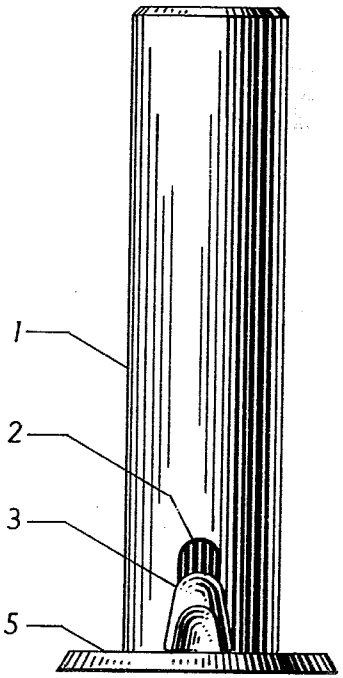
FIG. 1 shows a side view of a coin saver according to the present invention with transversing push means.
Figure 8A:
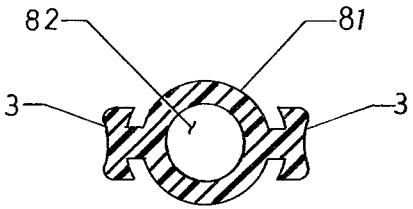
Figure 8B:
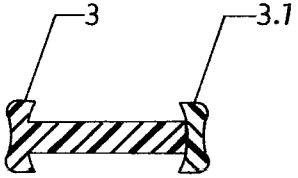

FIG. *8a* is a top view of a push means of FIG. 1 according to the present invention.

FIG. *8b* is a straight push means useful in the present invention.

BEST MODE FOR CARRYING OUT THE INVENTION

As shown in FIG. 1, 1 is the elongated member, in this case a cylindrical tube for containing the coins. While this tube is preferably cylindrical, it can be of any shape, e.g. triangular, square, etc. as long as it has a (preferably constant) inner diameter sufficient to contain the coins and wrapper. The tube may be of any material desired, but is preferably plastic such as polypropylene, polyethylene or commercially available acrylics for cost and weight saving purposes.

Figure 2:
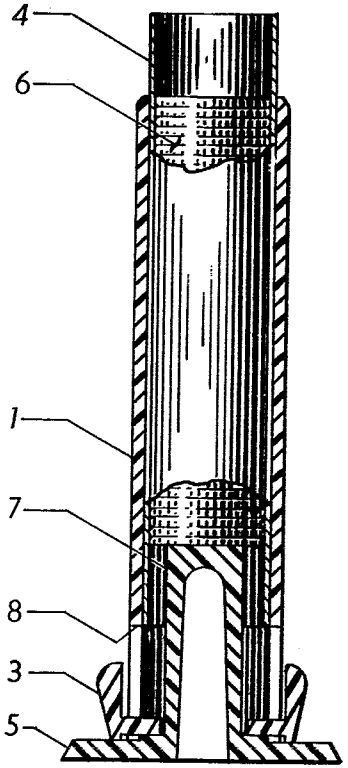
FIG. 2 shows a sectioned view of the coin saver of FIG. 1 containing a coin wrapper.

The base material 5 in FIG. 1 can be made of the same material as the tube 1 or a different material. It can be molded with the coin support (7 in FIG. 2) or molded separately and subsequently attached. As shown in FIG. 2, the base 5 and coin support 7 are preferably a unitary piece for both ease of fabrication and cost purposes. However, as with the base material, the post can be of the same material as either the base or the tube.

The push means 3 can be molded plastic (see FIG. *8a*) or easily formable metal such as aluminum wire. It should be sized so as to slide easily up and down in the formed slot 2. As shown in FIG. *8a*, tabs 3 are molded to a circular base 81 having opening 82 of sufficient size to slide over coin support 7 of FIG. 2. If the coin support and base are a single molded piece for example, the push means of FIG. *8a* can be simply slid over coin support 7 and tube 1 glued to base 5. In an alternate embodiment, the push means can be a straight "pin" traversing the column with slots formed accordingly. See FIG. *8b*. This piece can comprise either a single unitary molded piece such as plastic, or a straight plastic piece in two sections (3 and 3.1) which can be fastened together as by gluing after inserting into opening 2.

Figure 3:
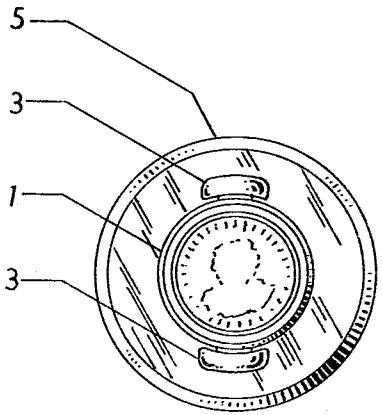
FIG. 3 shows a top view of the coin saver of FIG. 1.

In FIG. 3, the base is shown as 5, tube as 1 and push means tabs as 3.

The fabrication of the coin saver can be performed by conventional plastic molding operations. As much of the tube, base, coin support and push means that can be fabricated in a single molding method the better from a cost and efficiency point of view. However, the coin saver as shown in FIGS. 1, 2 and 3 is formed by molding the tube section, push means and combined base-coin support separately. The push means is then slid over the coin support, and the tube adhesively attached to the base by either softening by melting the two pieces, treating them with softening solvents or preferably utilizing an adhesive such as conventional epoxy or acrylic based adhesives, such as cyanoacrylate (Super Glue® by Duro), depending on the plastic utilized to form the pieces.

In operation, the coin wrapper 4 in FIG. 2 is slid down the tube until it contacts push means 3. The tube 1 is sized so that the top of the wrapper can slide below the top of the tube. The coins are then allowed to drop into the tube chamber in the wrapper and can be stored there until they reach the height of the top of the tube. The coin support 7 is sized so that the column of coins 6 extending from the coin support to the top of the tube 1 is an exact count to fill the coin wrapper. For example, in the case of pennies, this column would be 50 pennies high; in the case of nickels, it would be 40 nickels high; in the case of dimes, it would be 50 dimes high; etc. It could also be designed to accommodate foreign coins as well.

Once the column is filled, the push means 3 is grabbed between the fingers and slowly pushed upwards to the top of transversing slot 8, raising the coin wrapper 4 above the height of tube 1 a distance approximately one-half the length of the unfilled wrapper. That is, the amount of wrapper extending above the coins in the tube is approximately equal to the amount of wrapper extending below the column of coins supported by coin support 7. The wrapper is then folded in conventional fashion at the top of the tube and the tube inverted to allow the column of coins in the wrapper in conjunction with the wrapper, to slide out of the tube. At this point, all that remains to be done to complete the counting and wrapping operation is simply to fold the bottom portion of the wrapper, again in conventional fashion, over the column of coins.

The advantages the coin saver, counter and wrapper of the present invention provides is an inexpensive, relatively simple device for minimizing coin handling, counting and wrapping while saving the coins. The counting of the coins is eliminated because of the height of the tube. The inserting of the coins into the wrapper is greatly improved (i.e. no fumbling with ever-tilting coins with one finger in a wrapper while trying to insert additional coins while maintaining a rigid column). The actual wrapping is also greatly improved with the coin saver according to the present invention. Trying to maintain the coins contained in a wrapper while also trying to maintain a rigid column, i.e. preventing angular laying over of the coins, and at the same time, trying to maintain the coins equidistant from either end of the wrapper while simultaneously trying to fold down both sides of the wrapper, is a skillful operation for such a mundane task. However, with the coin saver, once the coins have been inserted, wrapping is simple and provides equal wrapping on either side of the coins—an easy operation simply by raising the push means and wrapping one end at a time. In addition to the tube designs, attached labels and insignias which may be used can provide a colorful means of advertising for any commercial purpose, for example the banking business.

Another aspect of the invention includes a simple tube-push means arrangement with no exterior tabs or transversing piece extending between the tabs. The coin support is of the same diameter as the coins such that the tube can slide up and down on the coin support. Note FIG. 6. The base and support are designed, however, such that the tube may not be slideably released upwardly off the top of the support when extended its full height. When the tube is resting on the base, the height of the tube above the coin support corresponds to a column of coins of specific count. When the tube is slid up the support to the full height allowed by the support, the wrapper is lifted up so as to extend one-half its full length above the mid-point of the column of coins. Wrapping can then take place in the same manner as with the tab embodiment.

Figure 4:
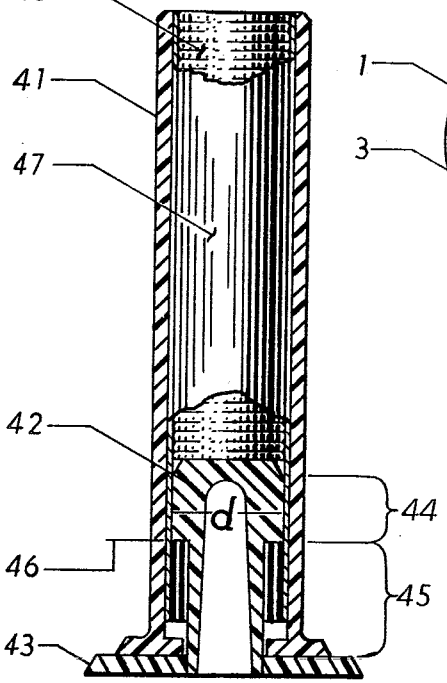
FIG. 4 shows a sectioned view of a coin saver according to the present invention where the wrapper push means comprises the elongated member itself.

FIG. 4 shows a cross section of the tabless embodiment of a coin saver according to the present invention. In this FIG., 41 indicates the tube, 42 indicates the coin support and 43 indicates the base. As can be seen, the diameter d of support 42 at section 44 extends the full diameter of the coins, while at section 45 it is small enough to allow the tube 41 to rise to point 46. The height 44 of the coin support is sized so that when the tube rises, one-half of the external portion of the wrapper remains exposed at section 44. The wrapper is shown as 47 and the coin stack as 48.

Figure 5:
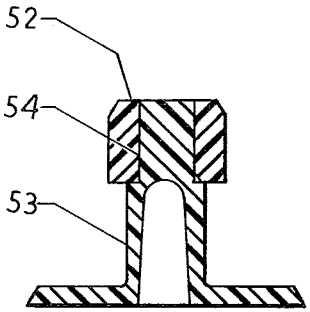
FIG. 5 is a sectioned view of a coin support according to the present invention.

The coin support 42 and base 43 can be molded as a single piece or as separate pieces and cemented with conventional adhesives. The variety of materials useful for making the post and base is the same as described for the tab embodiment above. Note also, FIG. 5 which shows a composite base-support where section 53 can be inserted at the base of the tube and concentric ring 52 simply slid down the tube to make contact. Adhesive is applied at point 54 prior to ring insertion on either the ring or the base to effect the bond.

Figure 6:
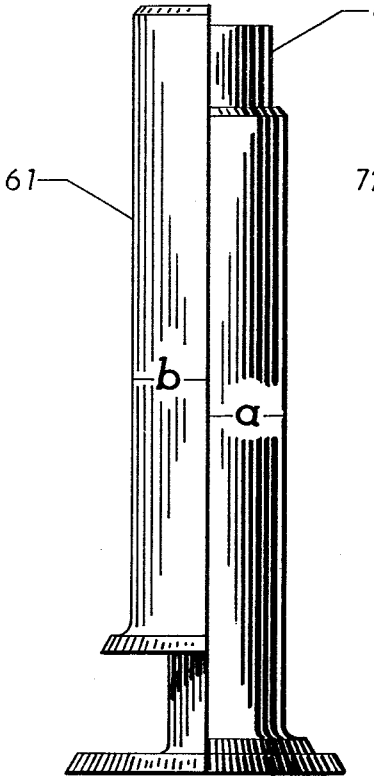
FIG. 6 is a side view of the coin saver of FIG. 4 in operation.

FIG. 6 shows the sliding tube in operation with section b being the tube 61 in a position so as to raise wrapper 62, and section a being the tube in the coin filled position with wrapper 62 raised so that one-half of the unfilled wrapper is extending above the top of tube 61 in preparation for wrapping.

Figure 7A:
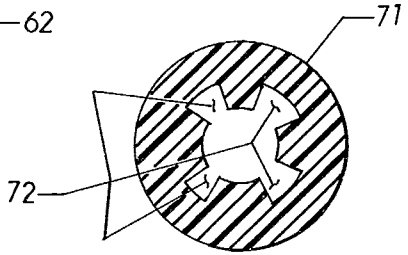
Figure 7B:
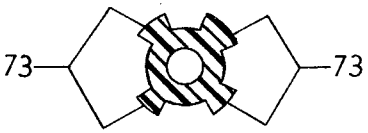

FIG. 7 shows another arrangement for inserting the coin support into the tube where FIG. *7a* shows the slot configuration of the base 71, and FIG. *7b* shows the insert configuration of the coin support. While the slots 72 in FIG. *7a* and inserts 73 in FIG. *7b* can all be the same size, they are preferably sized with descreasing width so that once inserted and twisted, they can only be removed when precisely aligned, an occurrence which would be highly unlikely statistically unless intentionally aligned. This could eliminate the need for any gluing, with the coin support simply inserted into the base and twisted for assembly.

Accordingly, it can be seen that what has been invented is a simple, convenient time-saving device for saving, storing and counting coins which solves a tiresome, tedious coin wrapping problem with relative ease.

Although this invention has been shown and described with respect to detailed embodiments thereof, it will be understood by those skilled in the art that various changes in form and detail thereof may be made without departing from the spirit and scope of the claimed invention.

I claim:

1. A combined coin saver, counter and wrapper comprising a hollow elongated member of sufficient diameter to retain a plurality of coins in straight column fashion in a coin wrapper, said elongated member mounted on a base section containing a coin support having a push means slideably mounted thereon, said push means positioned so as to contact the bottom of the coin wrapper and raise the wrapper while leaving the coin stack stationary, said coin support extending into the inner diameter of the elongated member at a sufficient height to maintain a specific count of the column of coins coextensive with the top of the elongated member when resting on the base section, the diameter of the elongated member being of sufficient size to allow the coin wrapper to freely slide around the column of coins, and the push means slideably mounted on the coin support so that when in its uppermost position, excess coin wrapper extends equidistant above the top of the elongated member when resting on the base and below the top of the coin support.

2. The coin saver of claim 1 wherein the push means comprises the lower portion of the elongated member slideably mounted on the coin support.

3. The coin saver of claims 1 or 2 wherein the elongated member is cylindrical.

4. A method of saving, counting and wrapping coins comprising placing a coin wrapper in an elongated member of sufficient diameter to retain a plurality of coins in straight column fashion in the coin wrapper, the elongated member mounted on a base section containing a coin support having a push means slideably mounted thereon, said coin support extending into the inner diameter of the elongated member at a sufficient height to maintain a specific count of the column of coins coextensive with the top of the elongated member when resting on the base section, the diameter of the elongated member being of sufficient size to allow the coin wrapper to freely slide around the column of coins and the push means slideably mounted on the coin support so that when in its uppermost position, excess coin wrapper extends equidistant above the top of the elongated member when resting on the base and below the top of the coin support, positioning the coin wrapper so that it extends no higher than the top of the elongated member, filling the elongated member with a column of coins to a height coextensive with the top of the elongated member, raising the push means thereby lifting the coin wrapper so that its unfilled portion extends equidistant on both sides of the column of coins, wrapping that portion of the coin wrapper extending above the top of the elongated member, removing the filled coin wrapper from the coin saver and completing the wrapping of the coins by wrapping the unwrapped portion of the wrapper around the coins.

5. The method of claim 4 wherein the push means comprises the lower portion of the elongated member slideably mounted on the coin support.

6. The method of claims 4 or 5 wherein the elongated member is cylindrical.

7. A combined coin saver, counter and wrapper comprising a hollow elongated member of sufficient diameter to retain a plurality of coins in straight column fashion in a coin wrapper, said elongated member mounted on a base section containing a coin support having a push means slideably mounted thereon, said coin support extending into the inner diameter of the elongated member at a sufficient height to maintain a specific count of the column of coins coextensive with the top of the elongated member when resting on the base section, the diameter of the elongated member being of sufficient size to allow the coin wrapper to freely slide around the column of coins, and the push means slideably mounted on the coin support so that when in its uppermost position, excess coin wrapper extends equidistant above the top of the elongated member when resting on the base and below the top of the coin support, the push means comprising a slideably mounted member surrounding the coin support and transversing the elongated member through slots in the elongated member of sufficient dimensions to allow the coin wrapper to be raised said equidistant measure.

8. The coin saver of claim 7 wherein the elongated member is cylindrical.

9. A method of saving, counting and wrapping coins comprising placing a coin wrapper in an elongated member of sufficient diameter to retain a plurality of coins in straight column fashion in the coin wrapper, the elongated member mounted on a base section containing a coin support having a push means slideably mounted thereon, said coin support extending into the inner diameter of the elongated member at a sufficient height to maintain a specific count of the column of coins coextensive with the top of the elongated member when resting on the base section, the diameter of the elongated member being of sufficient size to allow the coin wrapper to freely slide around the column of coins and the push means slideably mounted on the coin support so that when in its uppermost position, excess coin wrapper extends equidistant above the top of the elongated member when resting on the base and below the top of the coin support, positioning the coin wrapper so that it extends no higher than the top of the elongated member, filling the elongated member with a column of coins to a height coextensive with the top of the elongated member, raising the push means thereby lifting the coin wrapper so that its unfilled portion extends equidistant on both sides of the column of coins, wrapping that portion of the coin wrapper extending above the top of the elongated member, removing the filled coin wrapper from the coin saver and completing the wrapping of the coins by wrapping the unwrapped portion of the wrapper around the coins, the push means comprising a slideably mounted member surrounding the coin support and transversing the elongated member through slots formed in the elongated member of sufficient dimensions to allow the coin wrapper to be raised said equidistant measure.

10. The method of claim 9 wherein the elongated member is cylindrical.

* * * * *